US006498552B1

(12) United States Patent
Lozano Rico

(10) Patent No.: US 6,498,552 B1
(45) Date of Patent: Dec. 24, 2002

(54) ELECTROMAGNETIC RELAY

(76) Inventor: Santiago Lozano Rico, La Laguna, 7, P.I. Urtinsa, E-28923 Alcorcón, Madrid (ES)

( * ) Notice: Subject to any disclaimer, the term of this patent is extended or adjusted under 35 U.S.C. 154(b) by 0 days.

(21) Appl. No.: 09/582,017

(22) PCT Filed: Oct. 20, 1998

(86) PCT No.: PCT/ES98/00283

§ 371 (c)(1),
(2), (4) Date: Jun. 20, 2000

(87) PCT Pub. No.: WO00/24018

PCT Pub. Date: Apr. 27, 2000

(51) Int. Cl.[7] ..... H01H 51/22
(52) U.S. Cl. ..... 335/78; 335/80; 335/124
(58) Field of Search ..... 335/78–86, 124, 335/128, 17

(56) References Cited

U.S. PATENT DOCUMENTS

| | | | | |
|---|---|---|---|---|
| 4,771,253 A | * | 9/1988 | Sasaki et al. | 335/17 |
| 5,160,910 A | * | 11/1992 | Tsuji | 335/129 |
| 5,287,087 A | * | 2/1994 | Jencks et al. | 340/644 |
| 5,986,529 A | * | 11/1999 | Miyata et al. | 335/78 |

FOREIGN PATENT DOCUMENTS

| | | |
|---|---|---|
| DE | 18 98 007 | 8/1954 |
| EP | 0 131 218 | 1/1985 |
| WO | WO 96 41428 | 12/1996 |

OTHER PUBLICATIONS

Patent Abstracts of Japan, Sep. 17, 1990, vol. 014, No. 433 (E–0979) and JP 02 170326 A (NEC Corp), Jul. 2, 1990 see abstract.

* cited by examiner

*Primary Examiner*—Lincoln Donovan
*Assistant Examiner*—Tuyen T. Nguyen

(57) ABSTRACT

Electromagnetic relay having a bobbin (1), a mobile contact sheet (2) which is displaceable between two fixed contact sheets (3), an armature (11), a magnetic core (43) and a signaling plate (4) indicating the operation mode of the relay. Means are provided to situate the various parts such as the base (23), the support (9), the carcass (5) wherein a receptacle (6) may receive an interchangeable circuit plate (7). The bobbin-carrier spool (44) has six terminals at its upper part, two of which are used for the connection of the terminals of the bobbin, a third terminal used for relays having a second winding, the two terminals (19) and a sixth terminal (44) which is an auxiliary control terminal. Means are provided to indicate the relay operation mode through a LED (54) and to identify the relay by means of a removable label (56) placed on he cover (8).

12 Claims, 5 Drawing Sheets

ELECTROMAGNETIC RELAY

This application is a 371 of PCT/ES98/00283 filed Oct. 20, 1998.

OBJECT OF THE INVENTION

This invention refers to an electromagnetic relay of the type of relays that essentially incorporate a coil, a core, an armature, fixed and movable contact strips with associated terminals, as well as components for indicating the operational mode of the relay.

The relay, object of the present invention, tries to satisfy the demands of present technology in the applications of these components, mainly in these related to the automation of industrial process systems which involve, without harm to observe, visually, the state of the "Operative Relay". Furthermore it must meet the recommendations published in the low Voltage Directive relating to the application of these components.

The programmed control systems require that the parts used as "interface"in the signal inputs or outputs, (electromagnetic relays or solid state relays), be protected against instant over voltages carried in the lines or generated by the relay on disconnecting the coil.

To achieve this protection circuits suppressers with diodes, varistors, condensers, etc, are used that are connected in parallel or in series with the relay coil. These circuits can be located in the exterior of the relay for which it is necessary to have a base plate specially designed for this purpose, depending on single manufacturer, or better inside the relay. This last solution is that preferred by the design and maintenance technical personnel because it allows the using of standard base plats available in the market or including those already installed in the control equipment facilitating the maintenance work.

The positioning of those circuits in the interior of the relay presents problems due to the reduced dimensions of the available spaces likewise the difficulty of keeping the necessary isolation between these circuits and the output contact block of the relay. These problems are greater when it is a relay of small size that must meet with the international rules relating to the isolation between coil and contacts and with the protection levels established in said rules.

BACKGROUND OF THE INVENTION

Electromagnetic relays conventionally incorporate a coil mounted on a support from which extends a magnetic plate, likewise it has a rocker arm on which are mounted movable contact strips that move by tilting the arm towards the fixed contact strips due to the excitation of the coil.

The mechanics of these relays differs little between the different models available on the market. Essentially they consist of a magnetic circuit in the form of a U on one of whose arms a coil is a inserted and on the other a magnetic piece is held which on tilting closes the magnetic circuit. The force of attraction resulting on connecting the coil is applied by means of an isolating striker against the group of movable contact bearer strips. The supply terminals for the coil and those corresponding to the contact bearer strips extend to the exterior of the casing in a way that they maybe plugged into a base plate or appropriate female terminals.

In these relays the incorporation of protection circuits is found in every case to be limited to very simple circuits, made up of few components, which have to be distributed throughout the gaps allowed by the mechanics of the relay, without hindering the movement of the moveable parts y maintaining the necessary isolation. Connections between cables are normally done by means of soldered cables, such that the mentioned isolation distances are seriously affected and the labour employed is expensive.

The possibility of integrating the circuitry in the same relay established on an interchangeable board, likewise the integration of the different parts that make up the relay in a series of easily mounted base modules makes feasible the development of an electromagnetic relay such as that described below.

DESCRIPTION OF THE INVENTION

The electromagnetic relay proposed by this invention meets, to complete satisfaction, the expectations set out, being essentially structured by a multi-modular set of easy mounting that fundamentally has, a casing that has a receptacle designed to incorporate a small interchangeable circuit board, an armature on which are mounted the strips, terminals and magnetic plate, a spool for mounting the coil and a base module.

On the base module the support and spool of the coil with its different parts is mounted, all being enclosed in the interior of a large cavity defined by the casing.

The casing shows an open rectangular prismatic configuration for its lower face which leads to the forementioned internal cavity, which is found internally limited in height by a horizontal separation partition that constitutes the base of the little rectangle established in the upper face of the casing.

The circuit therefore will stay stored in the fore mentioned receptacle covered by an easily removable cover, which is extracted in order to proceed to change the small circuit board in this way making possible the easy interchangability of circuits with the object of guaranteeing different applications for the relay.

As well, the base module will be made up of a base plate from which extend some lateral partitions, which have openings for incorporating means of fastening the support and spool of the coil.

Likewise said base plate has a series of openings through which the relay terminals protrude to the exterior.

The mentioned armature is conceived as a support piece that integrates a series of vertical cavities for the incorporation of a movable strip and each fixed strip, likewise a lever that indicates the condition of the relay.

Likewise the internal structure has an opening that extends at high level in vertical position and that is made for the introduction of one of the arms of the magnetic circuit.

The spool of the coil is made up of a cylindrical part finished off in a lower base laminate that extends with respect to said part which has some end notches established for connection of terminals.

Likewise the said cylindrical part has an upper base sheet that extends in a promontory with a series of notches arranged in the same way vertically as the lower base, these upper notches being conceived to facilitate the joining of the fore mentioned terminals previously connected to the lower notches.

Starting from this structure of the constituent parts of the relay, a special configuration of the internal movement mechanism of the relay is conceived, that conventionally incorporates the fore mentioned indicating lever, and means of observing the relay condition, consisting of a visor situated in the upper part by which is observed if a signalling plate is below the visor in which case the relay is found to be activated.

The mechanism incorporates to such effect the armature that has a broad upper base situated over the core of the coil, from which extends a lower inclined arm that is positioned by its upper part against a strap that constitutes an elastic element against which it tilts, finding the lower extreme of the arm arranged in contact on a striker that acts moving the indicating lever.

The striker incorporates a broad vertical frontal face upon which contacts the fore mentioned arm of the rocker, from which subsequently extends at half level a rectangular ring that has in its middle part each with opposite ledges that are linked to the movable strip steadying its movement, having the mentioned rectangular ring in its extreme opposite to the frontal face with a latch in the form of a "T" that links to the indicating lever.

The mechanism thus conceived is found in its rest position with the movable strip in contact with one of the fixed strips.

When the coil is excited or when the push button is manually depressed, the rocker arm tilts and at the same time causes with the extreme lower part of its arm the movement of the striker, producing at the same time the movement of the movable strip towards the other fixed strip, likewise, the movement of the indicating lever, that will show its limits through a window made in the upper cover of the casing.

DESCRIPTION OF THE DRAWINGS

To complement the description that has been done and with the object of helping a better understanding of the characteristics of the invention, this descriptive statement is accompanied, as an integral part of the same, by a set of plans where with a non limiting and illustrative nature have been represented the following.

PREFERRED EMBODIMENT OF THE INVENTION

Figure 1:
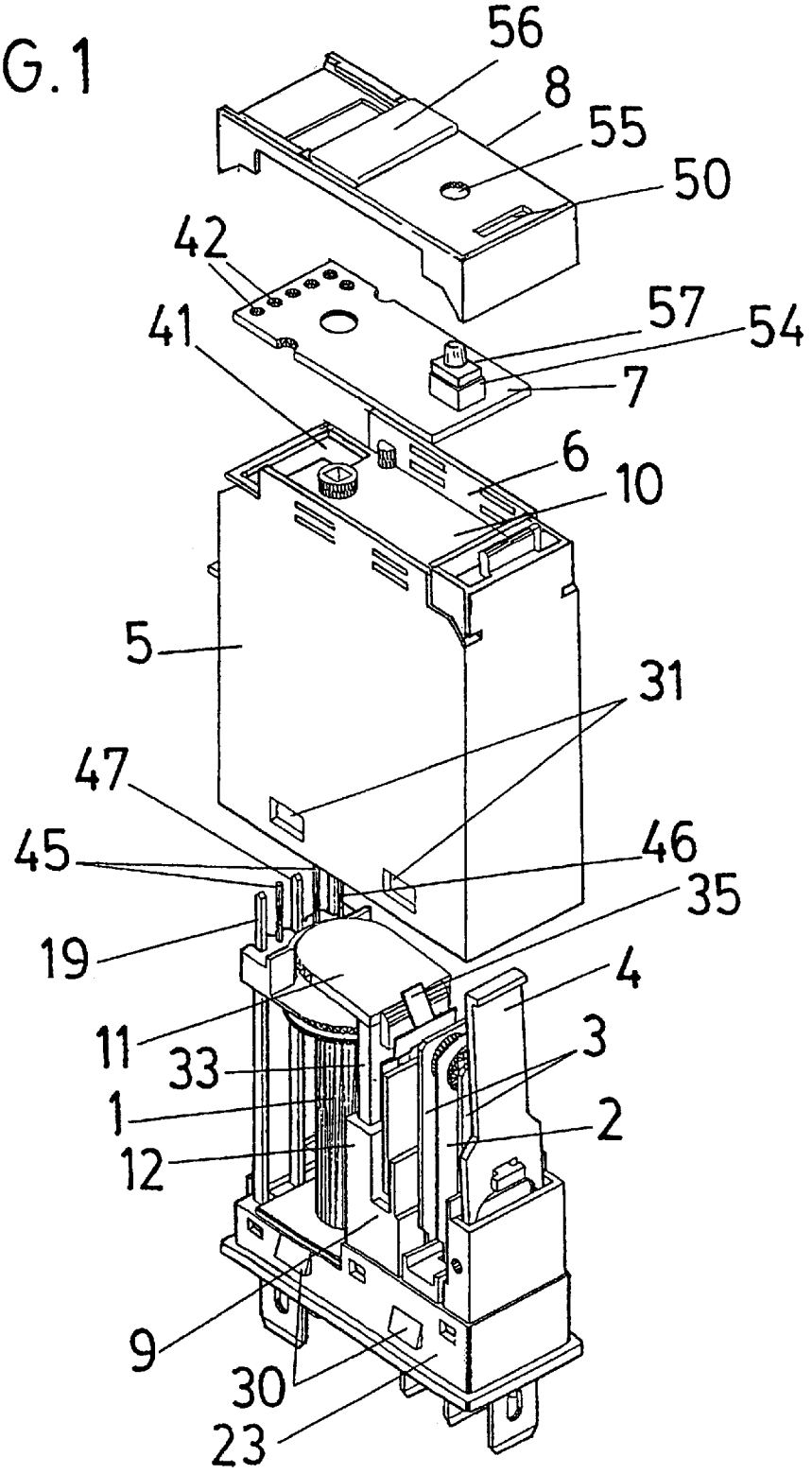
FIG. 1.—shows a view in perspective of the parts that form the casing of the electromagnetic relay and other internal parts that make up the relay.
Figure 2:
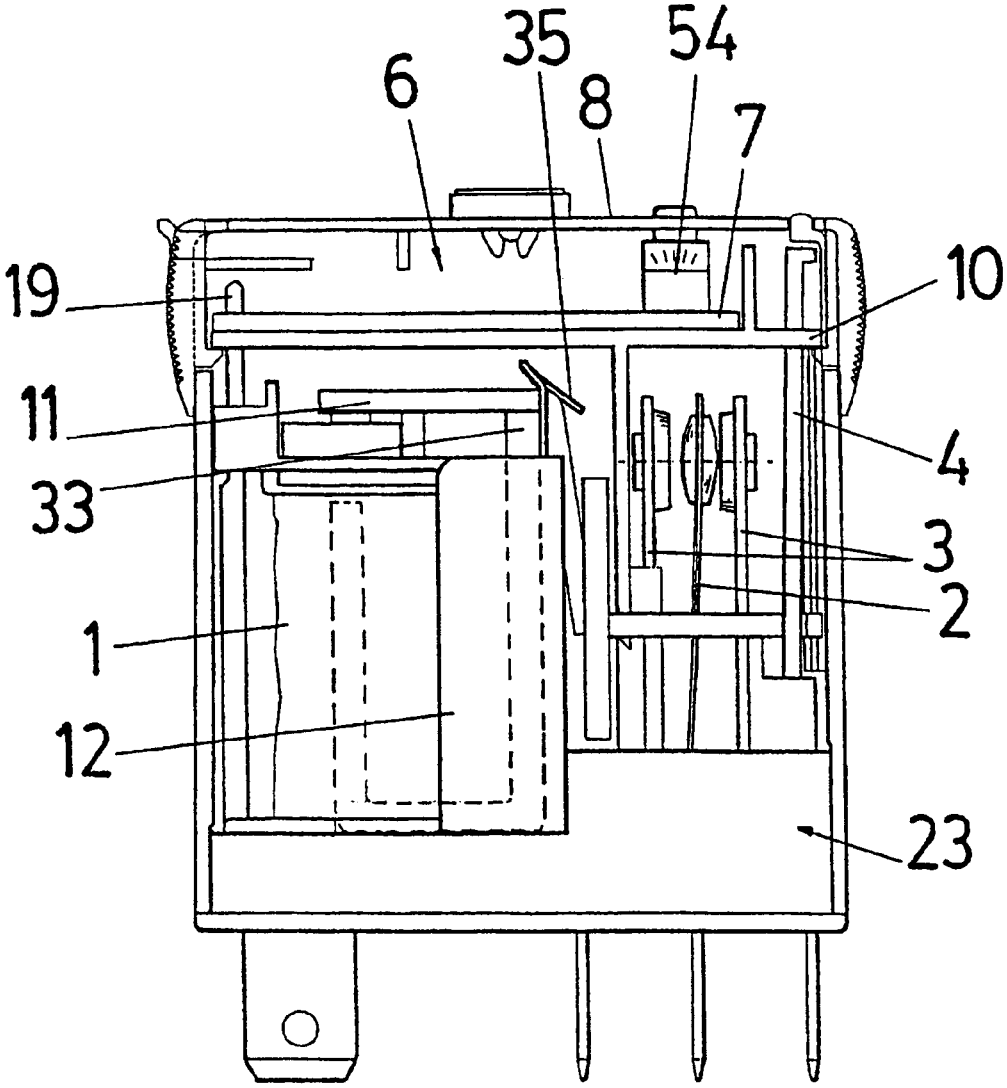
FIG. 2.—shows a lateral view of the interior of the relay in an activated condition.

In view of the mentioned figures following on is described a preferred means of execution of the electromagnetic relay object of this invention.

The relay extends from a basic constitution that fundamentally incorporates a coil (1), a movable contact strip(2), movable between two fixed contact strips. (3), an armature (11), a magnetic core (43), and its extension (33), and an indicating lever (4), of the activation condition of the relay.

Starting from these basic parts the relay stands out because it has the parts that are described below.

A casing (5) preferably prismatic in form, that shows a receptacle (6) established in its upper face that is limited at the bottom by a horizontal partition (10) that receives an interchangeable circuit board (7), the circuit board being covered in the receptacle interior (8). The circuit(7) has a LED state indication diode (54), that may be seen by way of a visor(55), situated above the cover(8),the light emitted by said LED diode(54), collected by a punched plastic that acts as a concentrator of the light haze emitted by the diode avoiding the illumination of the circuit(7), and allowing it to be seen clearly by way of the visor (55).

It is to be emphasised that the horizontal partition of the casing shows an opening for the passage of terminals ordered in line (19), (45), (47), which come from the coil and are introduced into openings(42), made in the interchangeable circuit boards(7).

Figure 4:
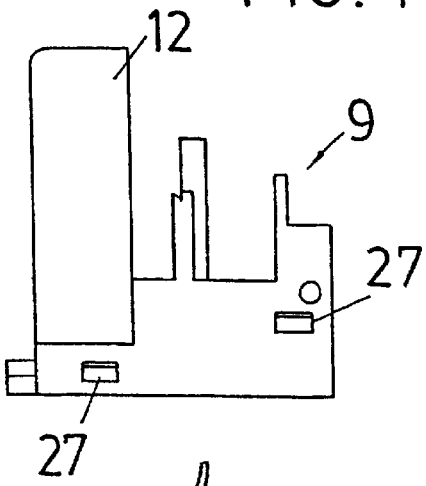
FIG. 4.—shows a lateral view of the support of different parts of the relay.
Figure 5:
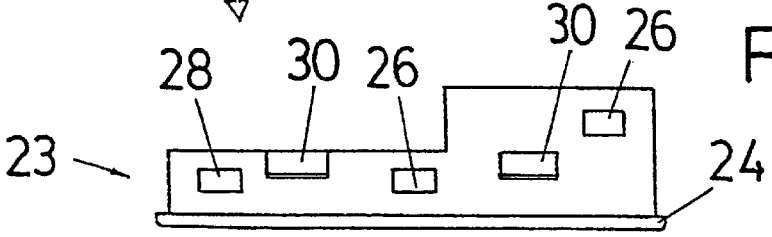
FIG. 5.—Shows a lateral view of the base of the casing of the relay.
Figure 6:
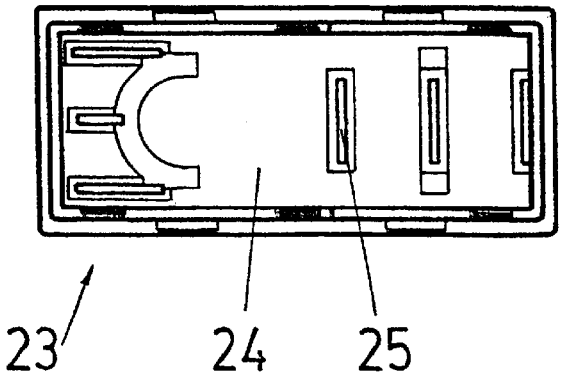
FIG. 6.—shows a plan view of the base of the relay.
Figure 7:
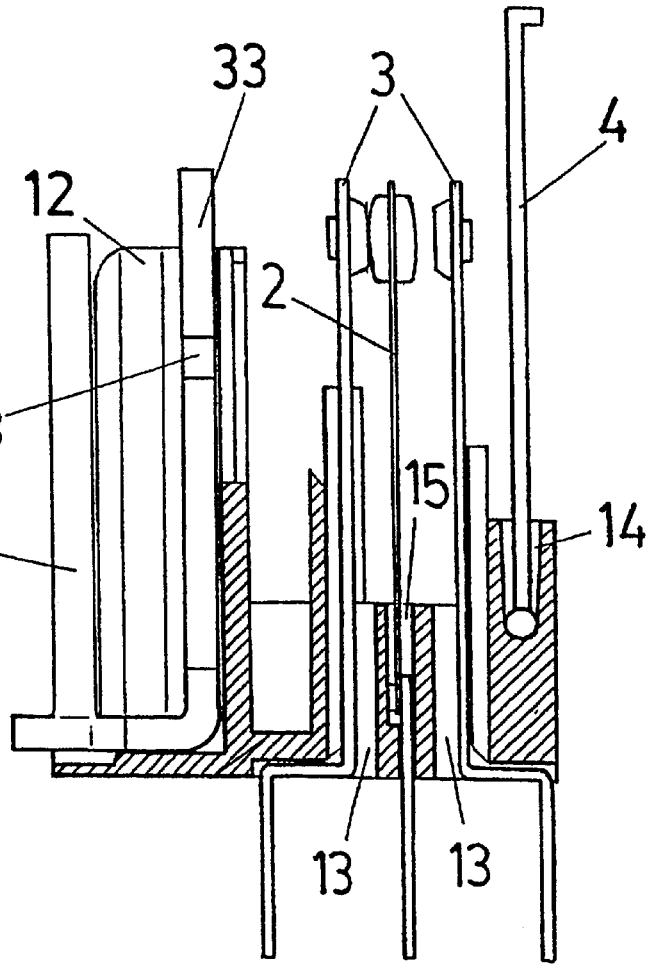
FIG. 7.—shows a lateral view of the contact strips support.
Figure 8:
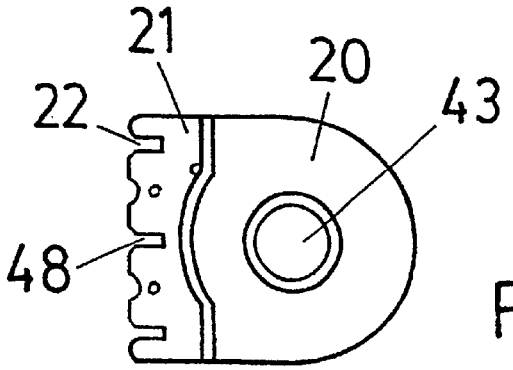
FIG. 8.—shows a plan view of the coil holding spool.
Figure 9:
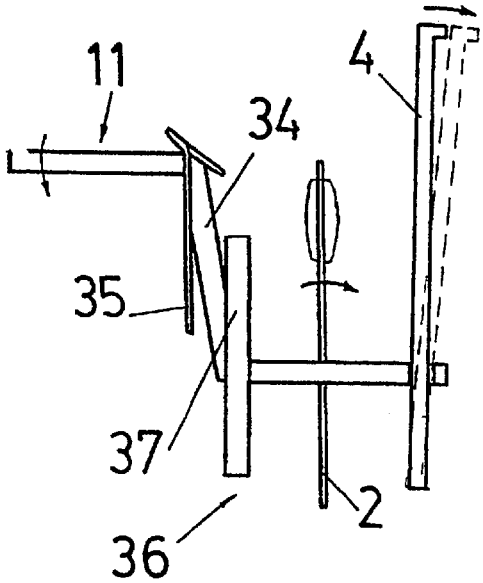
FIG. 9.—shows a lateral view of the working of the relay working movement.
Figure 10:
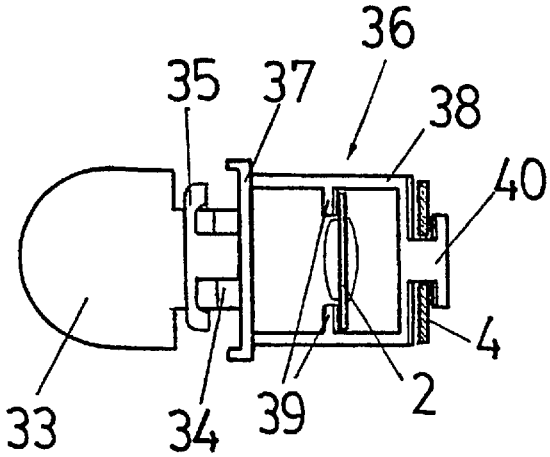
FIG. 10.—shows a plan schematic view of the working of the movement mechanism of the relay.
Figure 11:
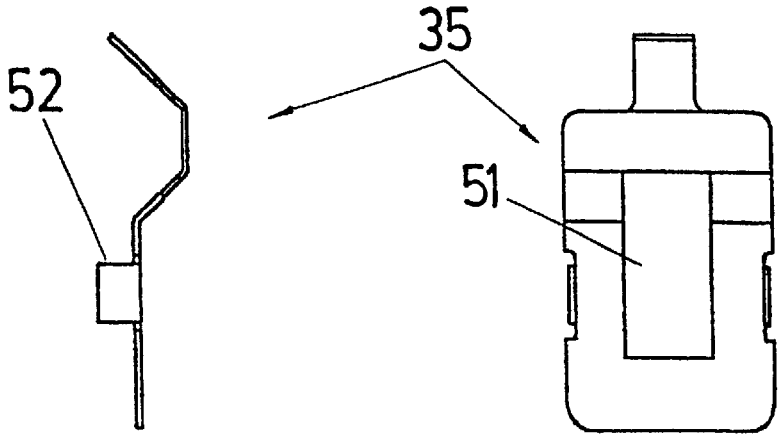
FIG. 11.—representation of the elastic strap.

The relay has likewise a support (9), FIG. 4, that vertical opening (12) destined to accommodate part of the magnetic core (33), likewise it has some through cavities (13), destined to partially hold the fixed contact strips (3), and an intermediate through cavity available between the quoted cavities(13), that partially accommodates the movable strip, (2), and a blind cavity that incorporates the signalling lever (4).

Figure 3:
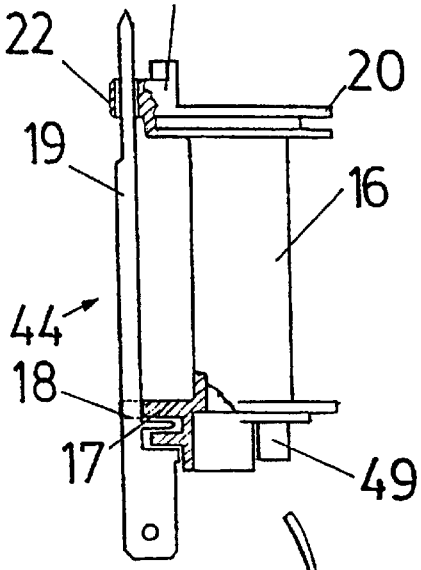
FIG. 3.—shows a lateral view of the spool that carries the coil.

Likewise it has a spool constituted by a cylindrical vertical portion (16), that accommodates the relay core(43), and where the coil is rolled, (1) that is finished off in a lower base laminate(17), that extends with respect to said part (16), said lower base (17) having some end notches established for connection of terminals. (19) And (47), likewise it has an upper base sheet laminate (20) that extends in a promontory (21) that has a series of notches (22) arranged in the same way vertically as the notches in the lower base (17), in which likewise are incorporated the mentioned terminals (19) and (47). The coil-bearing spool (44) is attached to the base by means of the latches (49). The terminals (19), FIG. 3 has in its lower part a ledge which allows its fixing in the ad hoc gap of the lower notch (22).

The beginning and end of the winding wire of the coil (1) is enrolled in the terminals (45) inserted in the upper part of the coil-bearing spool (44). A third terminal exists (46) necessary in the case of relays with a second winding. The input terminals of the relay (19) are inserted in the slots (18) of the coil-bearing spool (44). The sixth auxiliary terminal (47) is inserted in the slot (48), A terminal necessary in the case that an exterior control signal is required such as interlocking, etc.

On the other hand, with the object of facilitating the integration of these pieces, the relay incorporates a base module (23) that has a flat base (24) with openings (25) for the passing of terminals, that incorporate some openings (26) for the introduction of means of fastening (27) of the support structure (9), openings (28) for introduction of means of fastening of the cited spool (44) and means of fastening (30) for introduction in some openings (31) made in the side walls of the casing (5) in the joining position of the support structure (9), of the spool (20) and of the casing (5) over the base module (23).

Likewise it is contemplated that the relay has a movement mechanism made up of an armature (11) located above the coil (1) from which extends a lower inclined arm (34) that contacts with its upper part against an elastic strap (35) against which it tilts, having the lower extreme of the arm (34) in contact on a striker (36) that incorporates a wide vertical frontal face (37) upon which contacts the fore mentioned arm (34), frontal face (37) from which subsequently extend at middle height a rectangular ring (38) that has in its middle part each with opposite ledges (39) that are linked to the movable strip (2), such as said ring shows (38) in its opposite limit to the frontal face a latch (40) in the form of a T that links to the indicating lever, (4) that moves with the tilting of the armature (11). The indicating plate after been tilted will become visible through the window (50) made in the cover (8).

The elastic strap (35) that holds the armature (11) by the slot (51) the armature is introduced (11) and its location is secured by the hinges (52), to the core (33) in some extensions of this (53).

The lower cover (23) secures the position of the input terminals (19), of the contact-bearing strips (3), of the movable contact (2) and of the auxiliary terminal (47) that pass through the slots (25) and said cover (23) remains fastened attaching itself to the body (12). In this way all the terminals remain situated and fixed without them needing special equipment or rivets or soldering.

For the identification of the relay, this is provided with a removable label (56) located on the cover (8).

It is not considered necessary to make this description more extensive in order that whatever expert in the material may understand the reach of the invention and the advantages that may be derived from the same.

The materials, forms, size and layout of the parts will be susceptible to variation always and when they do not change the essentialness of the invention.

The terms in that this statement has been described will have to be taken always in a wide and non-limiting sense.

What is claimed is:

1. An electromagnetic relay having a coil, a movable contact strip movable between two fixed contact strips, an armature, a magnetic core, an indicating lever to represent an activation condition of said relay, and a casing, comprising:

a receptacle positioned in an upper face of said casing having a horizontal base for receiving an interchangeable circuit board, said interchangeable circuit board covered by a removable cover;

a spool a having a lower base including a plurality of lower notches for connecting to a plurality of terminals, and having an upper laminate base extending in a promontory including a plurality of upper notches for connecting to said plurality of terminals; and wherein said spool having an upper part including said plurality of terminals control at least one auxiliary function.

2. An electromagnetic relay having a coil, a movable contact strip movable between two fixed contact strips, an armature, and a magnetic core, comprising:

a receptacle established in an upper face having a horizontal base for receiving an interchangeable circuit board, said interchangeable circuit board covered by a removable cover;

an indicating lever for indicating an activation of said relay;

an LED for indicating a state of said relay;

a support having a vertical opening for holding part of a magnetic core;

support cavities at least partially accommodating said movable strip;

a blind cavity incorporating a signaling lever;

a spool having a lower base including a plurality of lower notches for connecting to a plurality of terminals, said spool having an upper laminate base extending in a promontory including a plurality of upper notches for the connecting to said plurality of terminals, said upper notches being incorporated into said terminals;

a base module having a flat base, said flat base having openings providing for passing of said terminals and further providing a means for fastening said support, spool, and side walls of said casing.

3. The electromagnetic relay according to claim 2 wherein said spool has a plurality of terminals.

4. The electromagnetic relay according to claim 2 wherein said relay further comprises an armature situated above said coil.

5. The electromagnetic relay according to claim 4 wherein said armature has a lower inclined arm.

6. The electromagnetic relay according to claim 5 wherein said lower inclined arm has an upper part contacting an elastic strap.

7. The electromagnetic relay according to claim 6 wherein said lower inclined arm tilts and contacts a striker.

8. The electromagnetic relay according to claim 7 wherein said striker incorporates a broad vertical frontal face.

9. The electromagnetic relay according to claim 8 wherein said broad vertical frontal face contacts said lower inclined arm.

10. The electromagnetic relay according to claim 9 wherein said broad vertical frontal face extends to form a rectangular ring, said ring forming a T-shaped latch for linking to said indicating lever.

11. The electromagnetic relay according to claim 2 wherein said relay can be mounted.

12. The electromagnetic relay according to claim 11 wherein said relay can be dismounted.

* * * * *